US011951354B2

(12) United States Patent
Zafar et al.

(10) Patent No.: US 11,951,354 B2
(45) Date of Patent: Apr. 9, 2024

(54) PORTABLE ORAL POSITIVE EXPIRATORY PRESSURE-GENERATING DEVICES WITH VARIABLE EXPIRATORY AIRFLOW RESISTANCES

(71) Applicant: University of Cincinnati, Cincinnati, OH (US)

(72) Inventors: Muhammad Ahsan Zafar, West Chester, OH (US); Ralph J Panos, Wyoming, OH (US)

(73) Assignee: University of Cincinnati, Cincinnati, OH (US)

( * ) Notice: Subject to any disclaimer, the term of this patent is extended or adjusted under 35 U.S.C. 154(b) by 0 days.

(21) Appl. No.: 17/479,465

(22) Filed: Sep. 20, 2021

(65) Prior Publication Data

US 2022/0088438 A1 Mar. 24, 2022

Related U.S. Application Data

(60) Provisional application No. 63/191,490, filed on May 21, 2021, provisional application No. 63/158,118, filed on Mar. 8, 2021, provisional application No. 63/080,471, filed on Sep. 18, 2020.

(51) Int. Cl.

| | |
|---|---|
| ***A63B 23/18*** | (2006.01) |
| ***A63B 23/03*** | (2006.01) |
| *A63B 21/00* | (2006.01) |

(52) U.S. Cl.

CPC ..... *A63B 23/18* (2013.01); *A63B 23/032* (2013.01); *A63B 21/4003* (2015.10)

(58) Field of Classification Search

CPC ..... A63B 23/18; A63B 23/25; A63B 23/03; A63B 23/032; A63B 23/182; A63B 23/185; A63B 21/0085; A63B 21/4003

See application file for complete search history.

(56) References Cited

U.S. PATENT DOCUMENTS

| | | | | |
|---|---|---|---|---|
| 8,177,689 | B2 * | 5/2012 | Rutten | A63B 21/00069 482/13 |
| 10,335,635 | B2 * | 7/2019 | Kezirian | A63B 21/0085 |
| 10,780,318 | B1 * | 9/2020 | Ghazzawi | A63B 23/18 |
| 11,357,938 | B2 * | 6/2022 | Soma | A61M 16/0866 |
| 11,420,095 | B2 * | 8/2022 | Aguirre, Jr. | A63H 33/00 |
| 11,452,838 | B2 * | 9/2022 | Rusher | A63B 21/023 |
| 11,464,924 | B2 * | 10/2022 | Bennett | A63B 21/0088 |
| 11,517,786 | B2 * | 12/2022 | Farrell | A61F 5/566 |

(Continued)

OTHER PUBLICATIONS

Heart rate. website: https://academic.oup.com/eurheartjsupp/article/9/suppl_F/F3/393361 (Year: 2007).*

*Primary Examiner* — Megan Anderson
(74) *Attorney, Agent, or Firm* — Brent M. Peebles

(57) ABSTRACT

A positive expiratory pressure-generating device for reducing breathlessness in a subject with one or more pulmonary disorders is disclosed. The device is rigid and hollow and can be held in the mouth of the subject. The device has at least one air chamber, at least one opening in the portion of the device that is held in the mouth and at least one additional airflow orifice. The device is configured to increase expiratory resistance and can be supported by the mouth of the subject without the need for additional support by hands, another device or other means.

16 Claims, 7 Drawing Sheets

(56) References Cited

U.S. PATENT DOCUMENTS

| | | | | |
|---|---|---|---|---|
| 2015/0231443 | A1* | 8/2015 | Halliday | A63B 23/18 482/13 |
| 2016/0375213 | A1* | 12/2016 | Zlupko | A61M 16/0493 128/200.24 |
| 2019/0105534 | A1* | 4/2019 | Lundquist | A63B 23/18 |
| 2022/0105387 | A1* | 4/2022 | Lundquist | G09B 19/00 |
| 2022/0168613 | A1* | 6/2022 | Boutros | A62B 9/06 |

* cited by examiner

PORTABLE ORAL POSITIVE EXPIRATORY PRESSURE-GENERATING DEVICES WITH VARIABLE EXPIRATORY AIRFLOW RESISTANCES

CROSS REFERENCE TO RELATED APPLICATIONS

This application claims priority to U.S. Provisional Application Ser. No. 63/080,471, filed Sep. 18, 2020, U.S. Provisional Application Ser. No. 63/158,118, filed Mar. 8, 2021, and U.S. Provisional Application Ser. No. 63/191,490, filed May 21, 2021, which applications are hereby incorporated by reference in their entirety.

TECHNICAL FIELD

The present invention relates to positive expiratory pressure-generating devices.

BACKGROUND OF THE INVENTION

Pulmonary diseases that are characterized by airflow obstruction (obstructive lung diseases) such as chronic obstructive pulmonary disease (COPD), emphysema, bronchiectasis, tracheobronchomalacia and excessive dynamic airway collapse (EDAC) lead to breathlessness, reduced exercise capacity, and poor quality of life (QoL). In all such conditions the collapse of the airways is exaggerated during the expiratory phase that has many subsequent consequences. In COPD, emphysema and bronchiectasis, the small and medium size air-tubes are affected. Their excessive collapse in expiration leads to increased air-trapping, incomplete exhalation and chest expansion, a phenomenon known as dynamic hyperinflation (DH). DH leads to poor exercise tolerance, exertional breathlessness, and exertional oxygen desaturation. EDAC and tracheobronchomalacia is characterized by excessive inward bulging of the main airways (trachea, main bronchi, lobar bronchi) impeding expiratory airflow, causing poor secretion clearance, recurrent bronchitis, cough and dyspnea. For patients with COPD, emphysema and bronchiectasis, modified breathing techniques such as use of pursed-lip breathing is taught to help slow down breathing, prolong expiratory phase and reduce DH. These techniques are hard to learn and apply and have variable effectiveness. For EDAC and tracheobronhomalacia the primary non-invasive therapy is continuous positive airway pressure (CPAP) that functions as a pneumatic stent preventing expiratory airway collapse. While CPAP improves symptoms for some patients, it is impractical for use during activities. Surgical interventions such as tracheobronchoplasty are beneficial for appropriate individuals but are not feasible for others. Manometry optimized positive expiratory pressure (PEP) breathing modalities improve dyspnea and exercise tolerance in EDAC. Therefore, for all such obstructive lung diseases, a need still exists for portable, hands-free, PEP-type device that can be used during activities and beyond.

SUMMARY OF THE INVENTION

The present invention involves a positive expiratory pressure-generating device for reducing breathlessness in a subject with one or more pulmonary disorders. The device is rigid and hollow. It can be held in the mouth of the subject. The device has at least one air chamber, at least one opening in the portion of the device that is held in the mouth and at least one additional airflow orifice. The device is configured to increase expiratory resistance. Also, the device is configured to be supported by the mouth of the subject without the need for additional support by hands, another device or other means. In one embodiment, the at least one air chamber has a volume of at least about 3 cubic centimeters. In another embodiment, the device also has an integrated structure suitable for connecting a lanyard.

In one embodiment, the width of the device is at least twice the height of the device. In another embodiment, at least 25% of the device is supported by the lips of the subject. In one embodiment, the device does not generate sound above an ambient sound level. In another embodiment, the device is a solid molded piece with no additional parts. In one embodiment, the air chamber of the device has a conical shape. In another embodiment, the device has at least two additional airflow orifices. In one embodiment, the device has at least three additional airflow orifices.

In another embodiment, the present invention involves a system for reducing breathlessness and increasing activity in a subject with one or more pulmonary disorders. The system uses multiple positive expiratory pressure-generating devices where each device comprises a rigid hollow device that can be held in the mouth of a user, device having at least one air chamber, at least one opening in the portion of the device that is held in the mouth and at least one additional airflow orifice. For this system, the multiple devices each have a different number of additional airflow orifices and the subject may use at least two of the devices to determine a preferred device for use in reducing breathlessness and increasing activity. In one embodiment, the subject uses at least three of the devices to determine a preferred device for use in reducing breathlessness and increasing activity.

In another embodiment, the present invention involves a method of reducing a subject's respiratory rate compared to the subject's normal respiratory rate. The method involves the subject placing a rigid hollow device in their mouth and breathing through the device for a period of time. The device has at least one air chamber, at least one opening in the portion of the device that is held in the mouth and at least one additional airflow orifice. The device is configured to be supported by the mouth of the subject without the need for additional support by hands, another device or other means, and further. Also, the subject has a breathing cycle with an exhalation phase and, when the device is in use, it prolongs the exhalation phase of the subject's breathing cycle.

In one embodiment, the subject has one or more pulmonary disorders and the method reduces breathlessness in the subject. In another embodiment, the pulmonary disorders may include excessive dynamic airway collapse (EDAC), tracheobronchomalacia, bronchiectasis and chronic obstructive pulmonary disease (COPD). In one embodiment, the period of time is at least one minute. In another embodiment, the at least one air chamber has a volume of at least 3 cubic centimeters. In another embodiment, the device also has an integrated structure suitable for connecting a lanyard.

In one embodiment, the device is used by the subject for period of time that is at least one minute. In another embodiment, the period of time is at least five minutes. In another embodiment, the period of time is at least ten minutes.

In one embodiment, the subject has a cardiovascular disease and an elevated heart rate, blood pressure, or both; and the device, when in use, reduces the heart rate and blood pressure of the subject. In another embodiment, the subject uses the device as part of a yoga routine, a mindful breathing exercise or both. In one embodiment, the subject uses the device to reduce anxiety, stress or both. In another embodiment, the subject uses the device when the subject is at rest, during exertion by the subject or during a recovery period after exertion. In one embodiment, the subject uses the device when the subject is at rest. In another embodiment, the subject uses the device during exertion by the subject. In one embodiment, the subject uses the device during a recovery period after exertion.

In another embodiment, the present invention involves a method of maintaining an oxygen saturation level for a subject with one or more pulmonary disorders who experiences exertional desaturation. The method involves the subject placing a rigid hollow device in their mouth and breathing through the device for a period of time, the device having at least one air chamber, at least one opening in the portion of the device that is held in the mouth and at least one additional airflow orifice. The device is configured to be supported by the mouth of the subject without the need for additional support by hands, another device or other means. Also, during exertion, the subject maintains an oxygen saturation level at or above 88% of a resting oxygen saturation level. In one embodiment, the one or more pulmonary disorders are selected from disorders consisting of excessive dynamic airway collapse (EDAC), tracheobronchomalacia, bronchiectasis and chronic obstructive pulmonary disease (COPD).

DETAILED DESCRIPTION OF THE INVENTION

Figure 1:
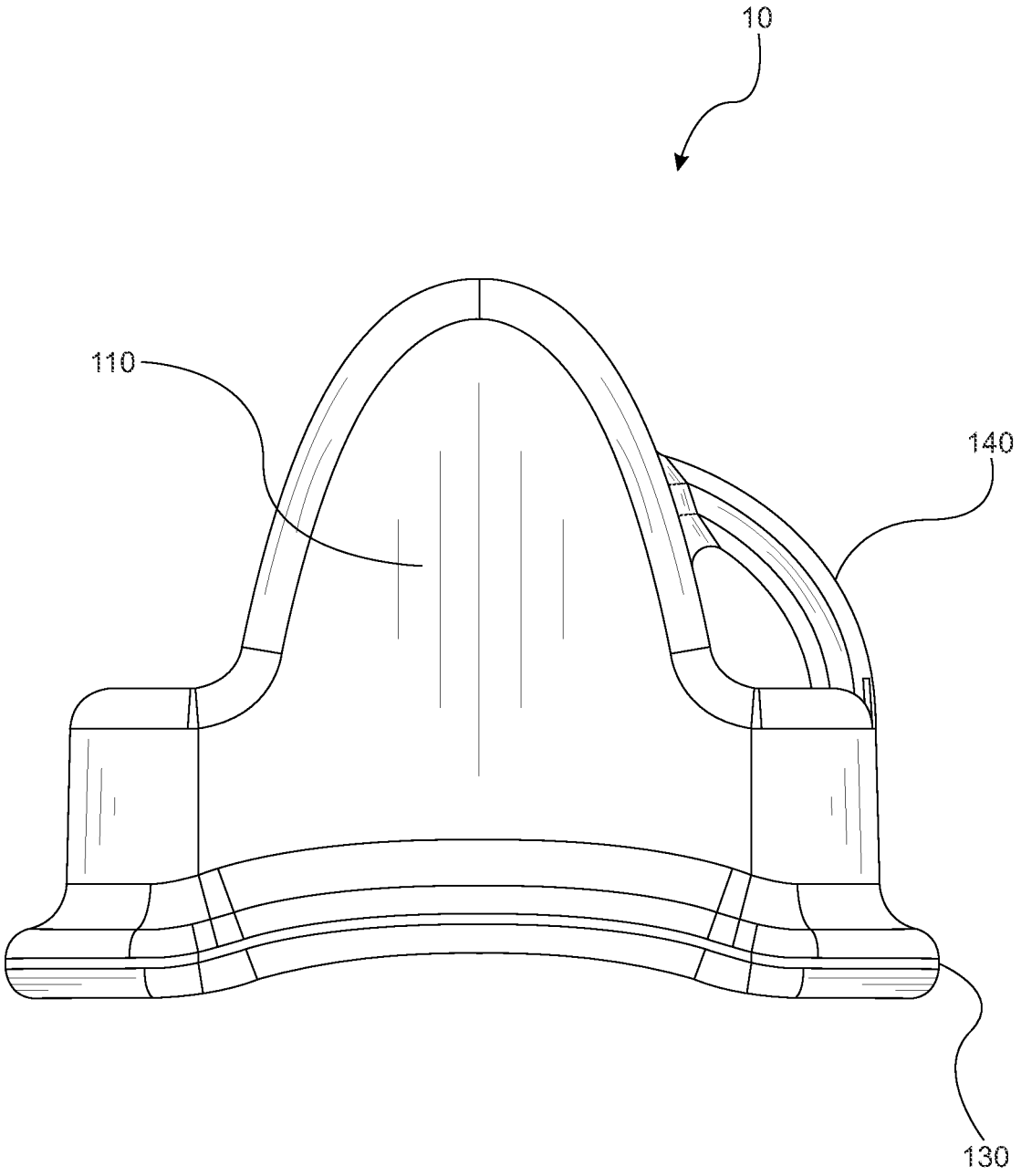
FIG. 1 illustrates a top view of a device according to an embodiment of the present invention.
Figure 2:
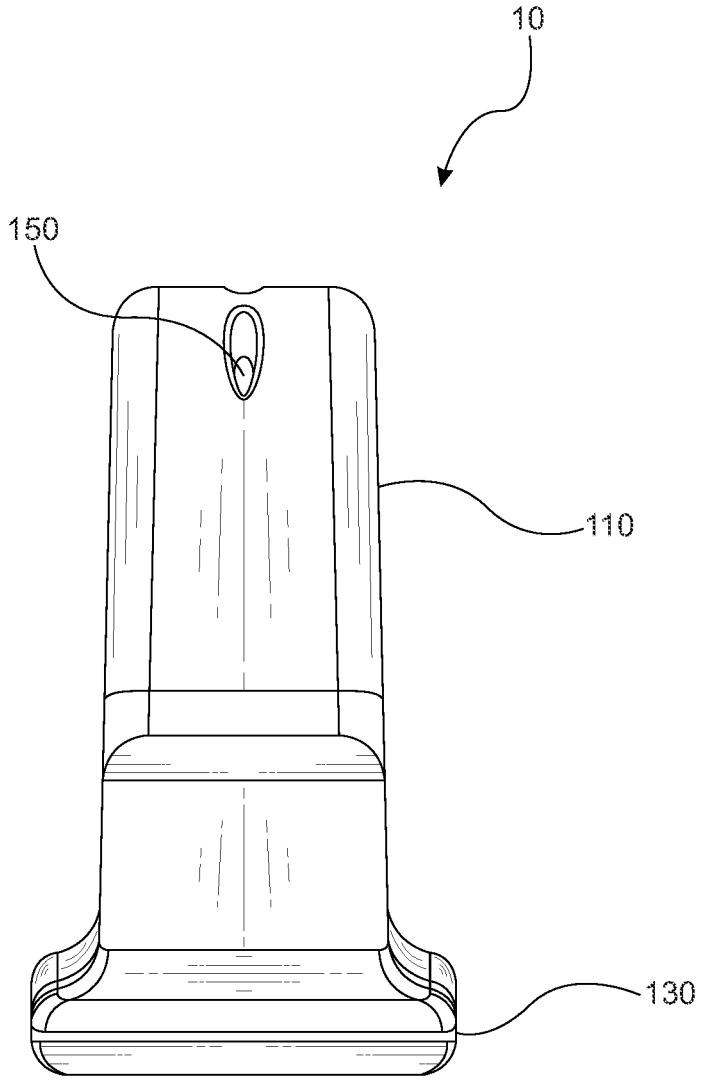
FIG. 2 illustrates a side view of a device according to an embodiment of the present invention
Figure 3:
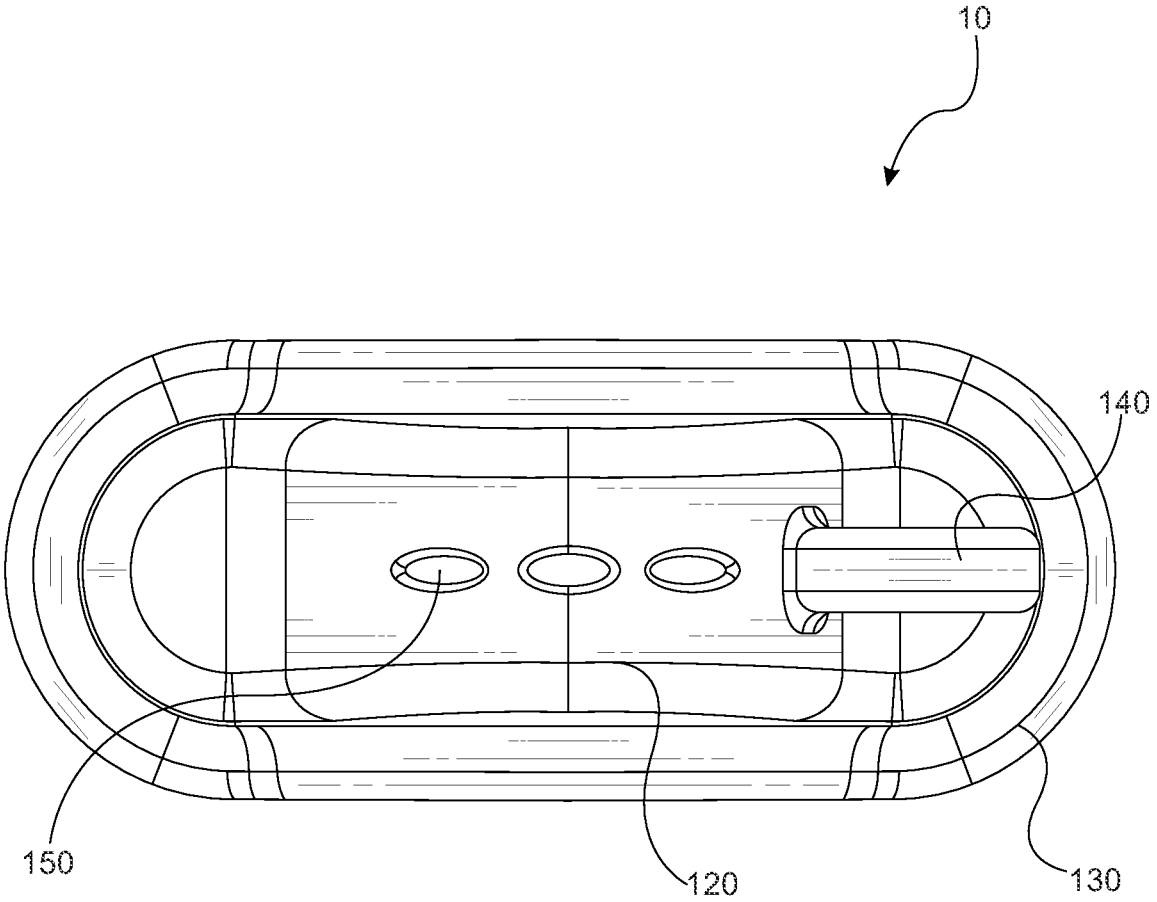
FIG. 3 illustrates a bottom view of a device according to an embodiment of the present invention
Figure 4:
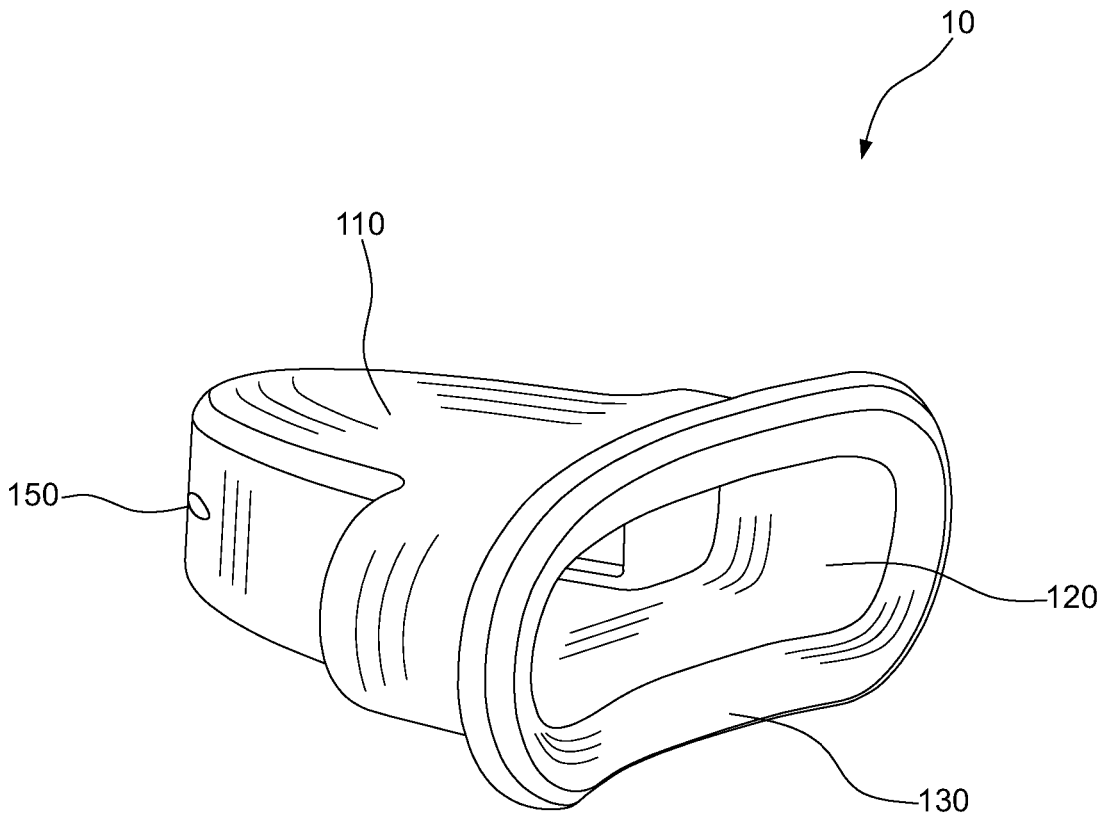
FIG. 4 illustrates a perspective view of a device according to an embodiment of the present invention

The details of one or more embodiments of the disclosed subject matter are set forth in this document. Modifications to embodiments described in this document, and other embodiments, will be evident to those of ordinary skill in the art after a study of the information provided herein.

The present disclosure may be understood more readily by reference to the following detailed description of the embodiments taken in connection with the accompanying drawing figures, which form a part of this disclosure. It is to be understood that this application is not limited to the specific devices, methods, conditions or parameters described and/or shown herein, and that the terminology used herein is for the purpose of describing particular embodiments by way of example only and is not intended to be limiting. Also, in some embodiments, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

While the following terms are believed to be well understood by one of ordinary skill in the art, definitions are set forth to facilitate explanation of the disclosed subject matter. Unless defined otherwise, all technical and scientific terms used herein have the same meaning as commonly understood by one of ordinary skill in the art to which the disclosed subject matter belongs.

Similar reference numerals will be utilized throughout the application to describe similar or the same components of each of the preferred embodiments of the implant described herein and the descriptions will focus on the specific features of the individual embodiments that distinguish the particular embodiment from the others.

As used herein, the term "breathing cycle" means the normal continuous respiratory process consisting of inspiration and expiration of air into and out of the lungs; one cycle includes all of one inhalation followed by all of one exhalation.

As used herein, the term "exertional desaturation" means a decline in a subject's oxygen saturation level to less than 88% while walking, ambulating, or performing any other activity.

As used herein, the term "exhalation phase" means that portion of the respiratory cycle during which exhalation occurs.

As used herein, the term "expiratory resistance" means the force required to complete the exhalation of air during the expiratory phase of the respiratory cycle.

As used herein, the term "mindful breathing" means a meditation or meditation-like practice that focuses the practitioner's attention on their breathing typically used to reduce anxiety or stress or other disadvantageous mood.

As used herein, the term "respiratory rate" means the number of complete respiratory cycles (including all of inhalation and all of exhalation) that occur in a period of time (usually a minute); the number of breaths an individual takes in one minute.

As used herein, the term "about," when referring to a value or to an amount of mass, weight, time, volume, pH, size, concentration or percentage is meant to encompass variations of in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed method.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

The design of the present invention provides a portable, hands-free, lightweight, oral, positive expiratory pressure-generating device. In some embodiments, the present invention can provide customizable positive expiratory pressure (PEP) by increasing expiratory airflow resistance. The present invention acts as a pneumatic stent for the large and small airways preventing expiratory airway collapse and reduces dynamic hyperinflation and its consequences. This mechanism of action can improve dyspnea, increase exercise tolerance, and mitigate exertional oxygen desaturation in many pulmonary conditions including but not limited to excessive dynamic airway collapse (EDAC), tracheobronchomalacia, bronchiectasis and chronic obstructive pulmonary disease (COPD).

Embodiments of the present invention have a novel design (see FIGS. 1-4). Referring to the Figures, an embodiment of the device of the present invention 10 is rigid and hollow. It can be held in the mouth of a subject in need of reducing breathlessness as a result of one or more pulmonary disorders. The device has at least one air chamber 110, at least one opening 120 in the portion of the device that is held in the mouth 130 and at least one additional airflow orifice 150. The device 10 is configured to be supported by the mouth of the subject without the need for additional support by hands, another device or other means. Not needing additional support makes the device more practical for use during normal activities. In one embodiment, the at least one additional airflow orifice 150 is located on the opposite side of the device 10 from the opening 120.

The overall shape of the device 10 is designed to fit comfortably in a user's mouth and be usable for a period of time during normal activities/exercise/or other activities of daily living. Therefore, in some embodiments, the width of the device 10 is at least twice the height of the device 10, allowing for a more natural fit in the mouth of the user. In addition, the weight distribution of the device 10 can be important. In some embodiments, at least 25% of the device 10 is supported by the lips of the user. This reduces weight-related issues for extended use of the device 10. In some embodiments, at least 35% of the device 10 is supported by the lips of the user.

In one embodiment, the air chamber 110 has a volume of at least 3 cubic centimeters. In another embodiment, the air chamber 110 has a volume of at least 4 cubic centimeters. In one embodiment, the air chamber 110 of the device has a conical shape. This conical shape affects the internal aerodynamics directing airflow through the airflow orifices 150.

In one embodiment, the device 10 also has an integrated structure suitable for connecting a lanyard 140. For example, a loop that allows a user to attach a lanyard using a clip. The addition of a lanyard allows for improved portability and convenience for ready access to the device 10 whenever its use is needed. For example, a lanyard allows the device 10 to be accessible without a need for pockets or holding it in the user's hand.

In some embodiments, the overall size of the device is large enough to not make it a choke hazard, but small enough so it does not obstruct the vision of the user while in use. The relatively small size of the device 10 makes it less obtrusive and less likely to generate negative attention (as some patients complain about oxygen nasal cannulas).

In one embodiment, the device 10 does not generate sound above an ambient sound level, so it does not produce a distracting noise. In another embodiment, the device 10 does not have any moving or electronic parts, nor does it require interfaces to a phone, smart watch or other device. In one embodiment, the device 10 is a solid molded piece with no additional parts. In another embodiment, the device 10 is constructed of plastic. This allows for ease of construction and cleanability.

In one embodiment, the device 10 has at least two additional airflow orifices 150. In another embodiment, the device 10 has at least three additional airflow orifices. In one embodiment, the device 10 has at least four additional airflow orifices.

Variable levels of PEP are generated by controlling the area through which air passes during expiration. The smaller the expiratory area, the higher the airflow resistance and the greater the level of PEP generated. In one embodiment, a series of devices are produced that have different areas for expiration. The expiratory area is determined by the number and size of holes/slits in the device. The fewer the number of holes/slits, the smaller the expiratory surface area and the higher the generated expiratory airflow resistance and the greater the level of positive end expiratory pressure generated. Conversely, the more holes/slits in the device, the larger the expiratory surface area and the lower the generated expiratory airflow resistant and the lower the level of positive expiratory pressure generated.

The devices of the present invention exert their physiologic effect through similar mechanisms as noninvasive ventilation but are portable, light weight, do not require power, and can be used during nearly all activities of daily living. In one embodiment, a series of devices with gradually increasing expiratory surface areas have been created to generate a spectrum of physiologically relevant elevations in expiratory pressure that mitigate dynamic hyperinflation and reduce clinical symptoms. The devices are small, lightweight and portable and can be attached to a lanyard to be worn around a person's neck similar to a necklace. In one embodiment, the present invention is created from plastic using injection molding. In another embodiment, the present invention is created from plastic using 3-D printing. In other embodiments, the devices can be manufactured using other methods and materials. The devices of the present invention are not intended to generate elevated sounds, like a whistle. In one embodiment, the device of the present invention does not generate sound above an ambient sound level. In another embodiment, the device is essentially noise free.

The present invention is the first PEP device designed to be portable, hands-free, lightweight and for use during exertional activities that can be customized to a patient's physiological requirements to produce clinical benefit. These PEP devices can be used in multiple different pulmonary disorders that are characterized by airflow obstruction and the development of dynamic hyperinflation. The mechanism of PEP generation is via airway resistance that can be modulated by changing the expiratory surface area. More PEP is generated with a smaller expiratory surface area. In some embodiments, the PEP devices have increasing number of holes/slits that provide a physiologic range of elevated PEP.

Figure 5A:
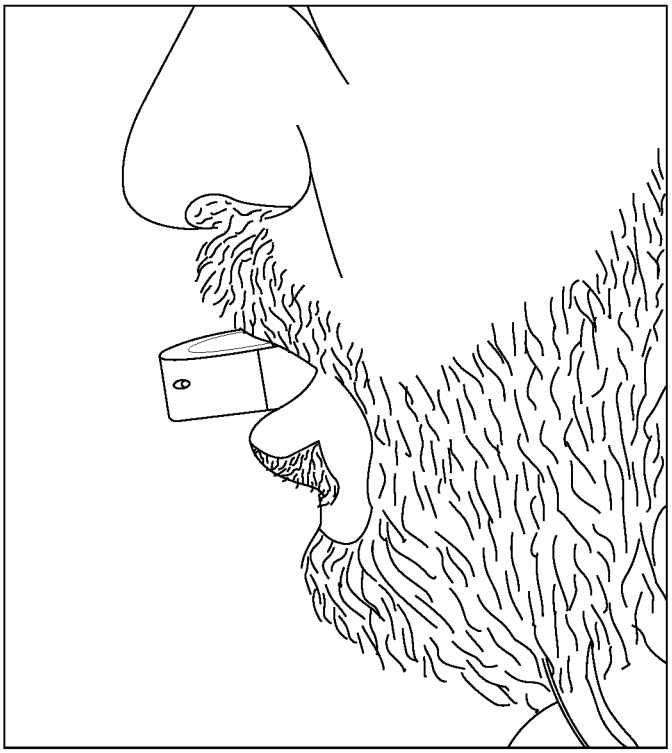
FIG. 5A is an image showing how the device of the present invention is held with the lips.
Figure 5B:
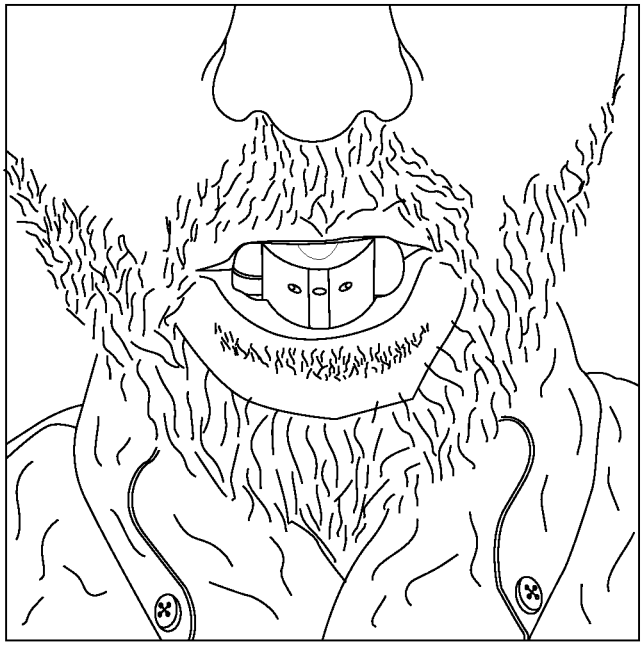
FIG. 5B is an image of another angle showing how the device of the present invention is held with the lips.

In one embodiment, the device of the present invention is held with the lips, like a small whistle, and may be attached to a neck lanyard for immediate access during exertion and expiration. Inspiration can be through the nose and/or mouth while expiration is directed through the present invention with lips sealed around it. As shown in FIGS. 5A and 5B, the device of the present invention is used by holding it in the mouth using lips or teeth and the user breathes out through the device creating a lip-seal around the mouth-side (air inlet side) of the device. In some embodiments, on the other end (air-outlet side) the device has different numbers or sizes of holes that generate different degrees of back pressure and effect on reducing respiratory rate and prolonging exhalation (see Table 1 and FIG. 6). The device can be used for an extended period of time. In one embodiment, the period of time is at least one minute. In another embodiment, the period of time is at least five minutes. In another embodiment, the period of time is at least ten minutes.

TABLE 1

| | Inventive Device (grade 1) | Inventive Device (grade 2) | Inventive Device (grade 3) |
|---|---|---|---|
| Device | 4-hole | 3-hole | 2-hole |
| Pressure (PEP) $mmH_2O$ | 4.7 | 6.6 | 10 |
| % decrease in RR | 20% | 45% | 45% |

As shown in the examples below, the devices of the present invention show efficacy in reducing breathlessness and increasing activity levels as well as ease of use with no adverse effects. One advantage of the present invention is to reduce exertional dyspnea and exertional desaturation. The devices are simple to produce inexpensively using readily available materials.

Without being bound by theory, the device of the present invention treats certain pulmonary disorders by 1) creating varying degrees of back-pressure, 2) reducing respiratory rate, 3) prolonging exhalation time and 4) providing a point of focus to facilitate conscious breathing. These features help in a variety of conditions in different people. For example, obstructive lung diseases, which include diseases such as, but not limited to, chronic obstructive pulmonary disease (COPD), emphysema, bronchiectasis, cystic fibrosis, trachea-broncomalacia (TBM) and excessive dynamic airway collapse (EDAC). Among these conditions, the device of the present invention reduces shortness of breath (dyspnea) on rest and exertion, improve oxygen saturation during exercise, reduces time need to recover after exertion and improves functionality. Another example is cardiovascular diseases, which include but are not limited to hypertension. Slowed, regulated breathing improves heart rates and lowers blood pressures.

In addition, the device of the present invention can help with anxiety, stress and ADHD. Slowed breathing with prolonged expiration time reduces the amount of stress and anxiety. This is partly also due to reduced levels of cortisol. ADHD and other hyperactivity conditions are helped by slowing breathing, prolonging exhalation, and providing a focus point. The present invention can increase focus and improvement attention. Further, the device of the present invention can help with mindful breathing, yoga and pregnancy. Prolonged exhalation, slower breathing and a conscious focus on breathing facilitates in yoga, mindfulness and in conditions of stress like pregnancy.

For conditions with central airway collapse (EDAC/TBM) a device that generates appropriate desired PEP for the individual patient will be needed (PEP device 1, 2, 3 or 4). This can be done by trying different devices and selecting one that generates highest pressure while easily tolerated. For conditions with smaller and medium size airway collapse (COPD, bronchiectasis) a standard PEP device 1, 2 or 3 will likely be effective as the amount of PEP needed to prevent dynamic hyperinflation and expiratory airway collapse may not vary between users.

In addition to being used in the management of obstructive lung disorders, this positive expiratory pressure device can be used to facilitate breathing during relaxation and stress or anxiety relieving practices, including but not limited to mindfulness exercises, yoga, and meditation.

Based upon the beneficial cardiovascular and psychological effects of slow breathing techniques, this positive expiratory pressure device might be effective in cardiovascular diseases such as hypertension and heart failure, mental health disorders such as depression, anxiety disorders, and post-traumatic stress disorder, and it might be used in conditions characterized by chronic pain.

The positive expiratory pressure device creates a variable expiratory resistance to exhalation that depends upon the device grade. This expiratory resistance produces a positive expiratory pressure that produces a pneumatic stent to maintain patency of airways in obstructive lung disorders reducing dynamic hyperinflation and decreasing air trapping and hyperinflation that mitigate breathlessness and oxygen desaturation that may occur in individuals with obstructive lung diseases.

In individuals who do not have obstructive lung disorders, the positive expiratory pressure device will produce a low level of positive expiratory pressure, prolong the expiratory phase of breathing, and reduce the respiratory rate. These changes in the breathing pattern, especially prolonged expiration and reduced respiratory rate, have significant physiologic and psychologic effects.

As the respiratory rate decreases to an optimal rate of six breaths per minute, fluctuations in the blood pulse synchronize with the heart rhythm which augments venous return increasing right ventricular cardiac output. Additionally, slow breathing increases fluctuations in heart rate (cardiorespiratory coupling) such that more heart beats occur during inspiration and less during exhalation through a mechanism known as respiratory sinus arrhythmia. It appears that maximal synchronization of respiratory rate and heart rate variability occurs at a respiratory rate of six breaths per minute which is called the resonant frequency effect. These fluctuations in heart rate match respiratory induced changes in hemodynamics with cardiac contractions. The improved cardiopulmonary coupling reduces blood pressure.

Reduced respiratory rate and positive expiratory pressure with increased tidal volume improves ventilatory efficiency by increasing alveolar recruitment and ventilation reducing alveolar dead space causing improved arterial oxygenation. Additionally, cardiorespiratory coupling may synchronize lung ventilation with heart rate right increasing ventricular cardiac output (pulmonary blood flow) to reduce physiologic dead space and maximize pulmonary ventilation and perfusion which improves pulmonary gas exchange efficiency.

Respiration also exerts significant effects on sympathetic (effect is to increase heart rate) and parasympathetic (effect is to decrease heart rate) nervous system activity. Slowing the respiratory rate augments parasympathetic nervous system activity and may inhibit sympathetic nervous system activity causing heart rate to slow.

In studies using electroencephalograms, slow deep breathing techniques cause increased alpha and decreased theta activity which were correlated with less anxiety, depression, anger, and confusion measured by various surveys. In a study using magnetic resonant imaging, slow breathing techniques increased BOLD activity in the prefrontal, motor, and parietal cortices, areas related to voluntary breathing, as well as in sub-cortical areas as the pons, the thalamus, the sub-parabrachial nucleus, the periaqueductal gray, and the hypothalamus, areas involved also in the regulation of internal bodily states.

Slow breathing exercise training for 30 min a day, 5 times/week for 12 weeks, under the supervision of certified yoga trainers reduced perceived stress levels measured by the Perceived Stress Scale (PSS) using Cohen's questionnaire. Yoga practice with a focus on breathing is more effective that yoga with a focus on meditation in Chinese college students who received 12 weeks of yoga training with either a breathing or meditative focus. Work intention, mindfulness, and perceived stress were measured by various surveys. Respiratory rate decreases during mindfulness-related meditation and the decrease in respiratory rate correlates with measures of mindfulness experience.

EXAMPLES

A series of examples are presented below. As shown in Example 2, PEP device use prevented expiratory central airway collapse and improved breathlessness, QoL, and exertional desaturation in a patient with severe EDAC and emphysema. The PEP device of the present invention is non-invasive, portable, inexpensive, and readily accessible during daily activities involving physical exertion which may allow patients to be more active and participate in other essential therapies of EDAC treatment like pulmonary rehabilitation. Surgical interventions may not be feasible for some patients and may have potential complications. Surgery stabilizes central airways; however, dynamic collapse can also involve the distal airways and flow-limiting segments can migrate peripherally. Treatment with CPAP is effective but not portable.

The mechanism(s) for attenuation of exertional desaturation by a PEP device may include improved ventilation-perfusion mismatch or reduced dynamic hyperinflation due to slower respiratory rate and prevention of small airway collapse. There were no changes observed in ventilation defects on the 129Xe MRI. However, the measurements were made at rest and may not reflect potential beneficial effects on ventilatory distribution and exertional gas exchange during exercise with the PEP device. The results presented show that the PEP device may enhance QoL and relieve dyspnea in individuals with EDAC and severe emphysema.

Example 1

Figure 6:
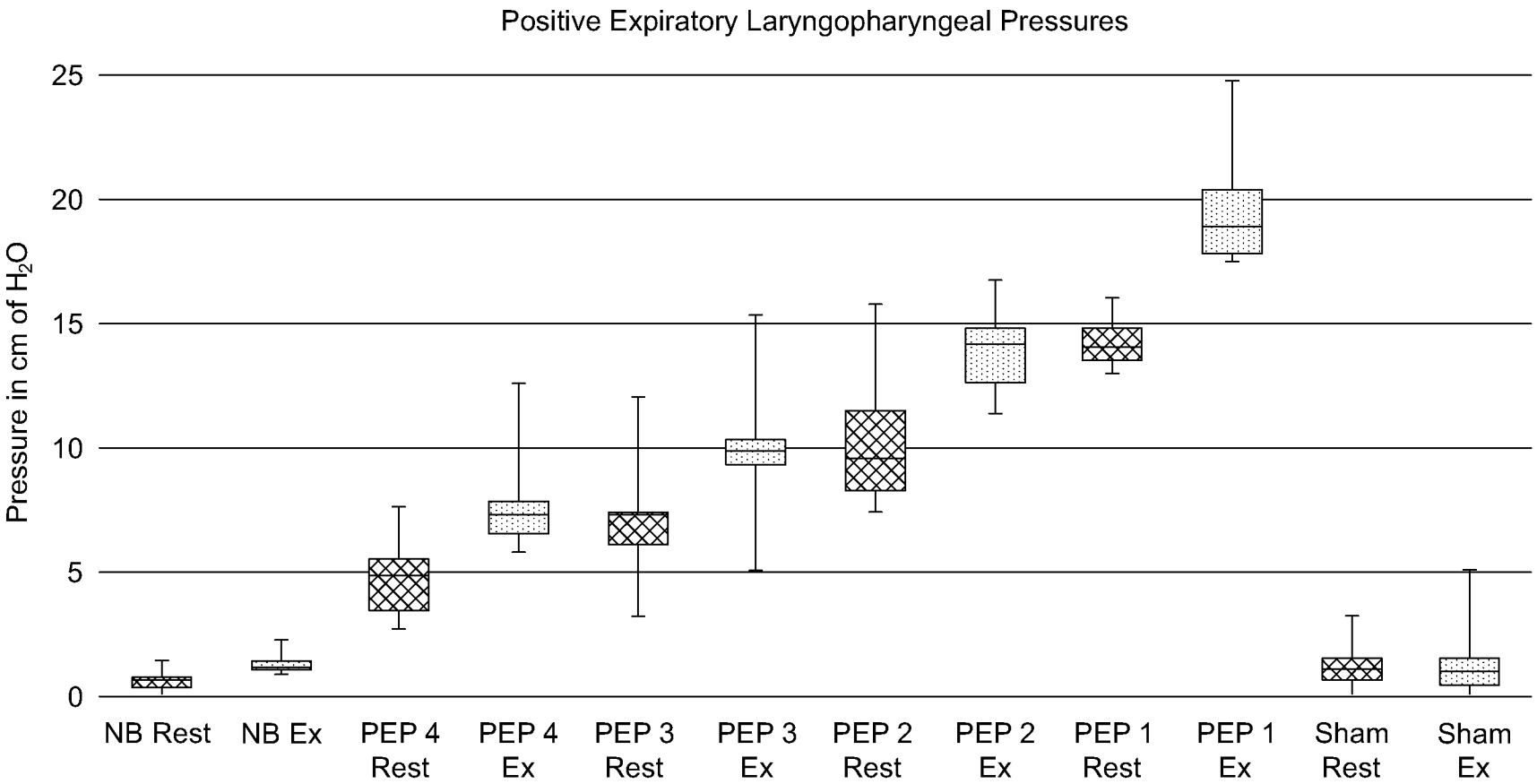
FIG. 6 is a graph showing positive expiratory laryngopharyngeal pressures using different grades of oral-Positive Expiratory Pressure (PEP) devices in normal subjects at rest and during exercise.

Laryngo-pharyngeal pressures were measured at rest and during exercise in five normal subjects using different designs of the present invention with varying expiratory areas—"PEP 1" to "PEP 4." Each grade generates different levels of PEP with the pressure increase ranging from κ to 17 cm $H_2O$ depending upon the expiratory surface area. Each PEP device 1 to 4 has a different expiratory surface area that is determined by the number of holes/slits in the device: "PEP 1" has 1 hole/slit. "PEP 2" has 2 holes/slits; "PEP 3" has 3 holes/slits; "PEP 4" has 4 holes/slits. The results are shown in FIG. 6, which shows a box-plot of the positive expiratory pressures (PEP) generated. The laryngo-pharyngeal pressures were measured using high-resolution esophageal manometer placed in the upper airway during restful breathing and during bicycle ergometer exercise (Ex). The pressures are near zero during normal breathing (NB) and with use of the sham device.

Example 2

A 31-year-old female subject with galactosialidosis, bronchiectasis, and pan-lobular emphysema was evaluated for dyspnea and frequent exacerbations. An awake bronchoscopy demonstrated severe EDAC that was mitigated with 12 cm $H_2O$ CPAP (see Table 2).

TABLE 2

| Diagnostic Evaluation Findings | | |
|---|---|---|
| Pulmonary Function Test | | |
| Forced expiratory volume in 1 sec | 0.71 L | 26% predicted |
| Forced vital capacity | 1.40 L | 44% predicted |
| Total lung capacity | 4.49 L | 102% predicted |
| Residual volume | 3.03 L | 251% predicted |
| DLCO | 6.57 ml/min/mm Hg | 29% predicted |
| Arterial blood gas | | |
| pH | 7.46 | |
| $pCO_2$ | 32 mm Hg | |
| $paO_2$ | 60 mm Hg | |
| Chest CT scan (static inspiratory and expiratory images) | | |
| Severe pan-lobular emphysema. Diffuse bronchial wall thickening. Greater than 50% collapse of the left main stem bronchus on expiration. Findings compatible with bronchomalacia Mosaic attenuation on expiratory images, compatible with air trapping. Opacification of the left inferior lingular segmental bronchus, with collapse and consolidation of the posterior aspect of the lingula. | | |
| Awake Dynamic Bronchoscopy | | |
| Central airway region | Expiratory collapse compared to inspiration (% reduction in size) with tidal breathing | |
| Trachea | mid-trachea: 50%, distal trachea: 60% | |
| Right main bronchus | 70% 2 cm length | |
| Left main bronchus | 95% 4 cm length | |
| CPAP titration level for ≤50% expiratory collapse | 12 cm of $H_2O$ | |

The baseline exercise capacity, exertional dyspnea and QoL were assessed by a 6 Minute Walk Test (MWT), UCSD Shortness of Breath questionnaire (UCSD-SOBQ), and the St. George's Respiratory Questionnaire (SGRQ), respectively. PEP devices with variable resistances were tested and the PEP device generating the highest tolerable pressure was prescribed for use during daily activities (8-10 cmH20 PEP). After 2-weeks, the outcome metrics were repeated. Minimal clinically important differences (MCID) were used to define significance. The subject rated the overall benefit of device from 0-10 (10 being best) and provided feedback. Proton and hyperpolarized 129Xe Magnetic Resonance Imaging (MM) was performed with and without a PEP device during tidal breathing at rest and gated to end-expiration via a respiratory belt. Images were segmented to measure the tracheal cross-sectional area. Regional ventilation was assessed by analyzing the 129Xe ventilation defect percentage.

The MRI showed marked expiratory central airway collapse that was most severe in the mid-distal trachea, narrowing to 80 $mm^2$ cross-sectional area. With PEP device, the expiratory cross-sectional area increased to 170 $mm^2$. The SpO2 was >90% throughout the MRI and there were no differences in $^{129}Xe$ MM ventilatory defects during tidal breathing with and without PEP device (38.3% vs 40.2%).

After two-weeks of PEP device use, dyspnea, QoL and exertional dyspnea significantly improved. The UCSD- SOBQ declined from 69 to 42 (Δ-27, MCID≥5), SGRQ decreased from 71 to 27 (Δ-44, MCID≥4) and pre- and post-6 MWT BORG score difference improved from Δ3 to Δ2 (MCID≥1). 6 MW distance did not change (Δ-25 feet, MCID≥98). During the 6 MWT on room air without the PEP device, the SpO2 declined from 91% to a nadir of 83% (Δ-12%) with recovery time to baseline BORG of 3 min, whereas with the PEP device, the nadir was 90% (Δ-1%) and recovery time to baseline BORG was 1 min.

The subject rated the benefit of the PEP device as 9/10. She used the device for approximately 33-66% of activities and reported that it helped control her breathing, decreased her exertional respiratory rate, and reduced anxiety due to breathlessness. She cited no major challenges with utilizing the PEP device other than occasionally forgetting to use it.

Example 3

Various subjects with COPD used devices according to the present invention (PEP devices) while performing daily activities. The subjects provided the following feedback:

Subject 1: Feels that the device has been very helpful. Was excited to try the device and overdid it initially. After the first week he got a system down. He reports that once he did that, he increased his activity level. He gave an example of an activity that he does every Sunday. He has to move tables and chairs. It would normally take him 15-20 minutes to recover. With the use of the PEP device, it cut his recovery time by more than half. He reports that he can usually tell when his oxygen decreases because he gets lightheaded, and he feels it is related to his oxygen saturation. With use of PEP device, he has not felt lightheaded at all. He felt the device was very helpful and has been mentioning it to others with COPD at pulmonary rehab that he attends. Feels strongly that others should try it since it has helped him so much. He did not need to use albuterol inhaler as much as he did before.

Subject 2: Used the device before and while going up the stairs. She was not breathing as hard at the end.

Subject 3: Helps him with recovery.

Subject 4: Recovered very quickly. Described recovery using the device as "fabulous".

Subject 5: Quicker recovery and prevents breathlessness when used before exertion. Felt it was like pursed lips breathing but better.

Subject 6: Helped when very short of breath—Used when moving around and breathing got bad—used during exertion and for recovery.

Subject 7: Helped her to calm down. Instead of fixating on not getting enough air, she focused on keeping the device in her mouth. It distracted her from stress. It helped with deeper breathing and with exhaling easier.

Subject 8: Made it easier to breathe and recover faster. If she forgot to use it, she noticed slower recovery time.

Subject 9: Used PEP device both during exertion and for recovery, used going up and down stairs. Not having to use emergency inhaler.

Subject 10: The amount of pressure is really very helpful. It helps with good breathing practices. Feels it is better than (breathing training in) pulmonary rehab because of the consistency. He used for walking, before walking and sometimes after for recovery.

Subject 11: Used when he knew a "stressful" situation was coming—carrying heavy loads and stairs.—Easy to use.

Subject 12: Anxiety from not being able to catch breath makes my shortness of breath worse.—having the device makes be less scared.

Example 4

Figure 7:
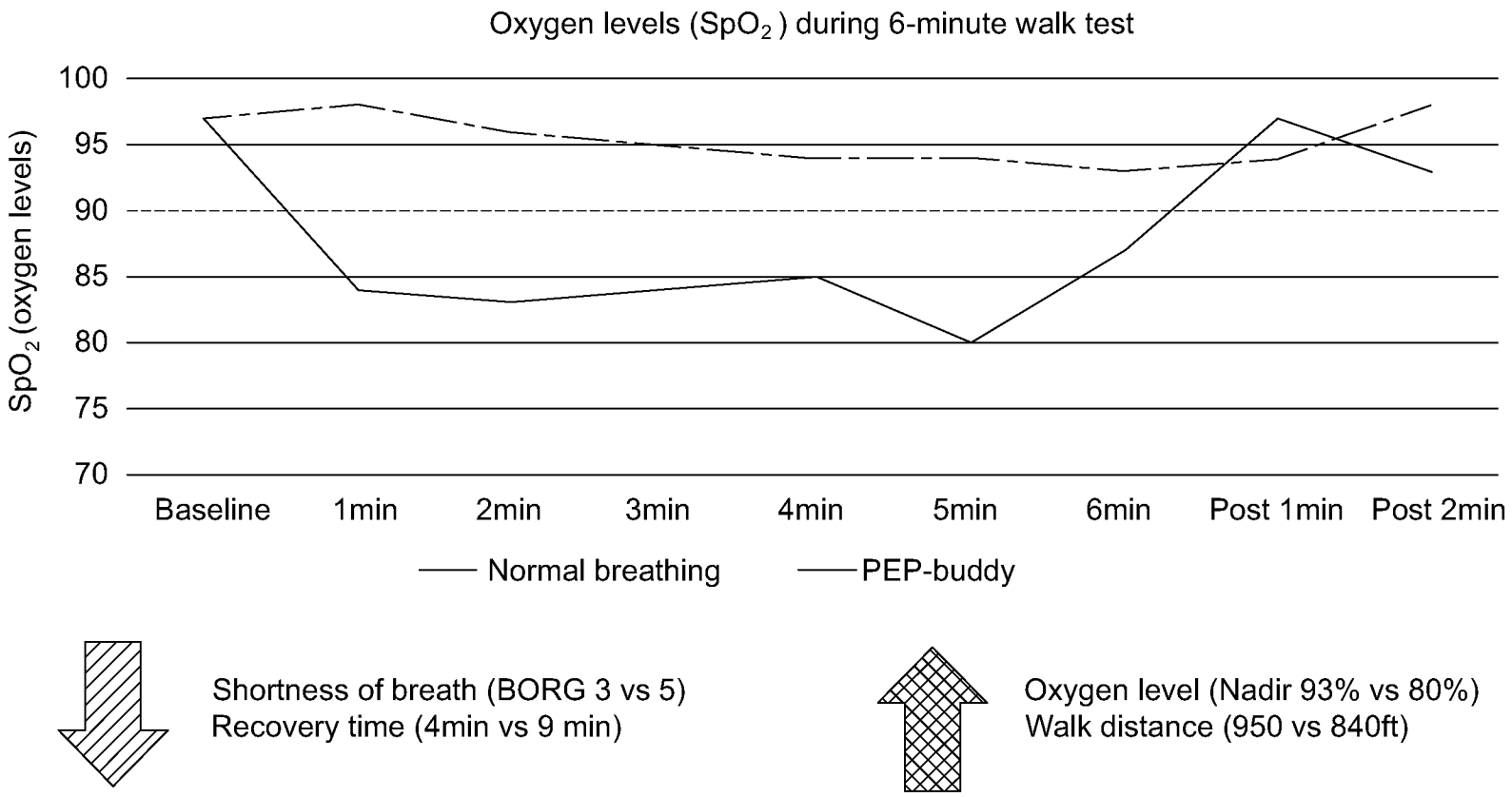
FIG. 7 is a graph showing the effect of a device of the present invention on the exertional oxygen level in a subject with COPD and exertional desaturation.

FIG. 7 demonstrates the effect of the PEP device of the present invention on exertional oxygen level in one of the patients with COPD and exertional desaturation. On qualitative interviews, among the responders, participants found the PEP device of the present invention useful in shortening the recovery time after exertion, it improved shortness of breath in day-to-day life activities, increased self-confidence and improved functionality in daily life. The same principles of shortness of breath, dynamic hyperinflation and obstructive flow limitations also influence people with bronchiectasis and cystic fibrosis. So, the present invention may be used in those people for improving shortness of breath, exercise capacity, exertional oxygen, reduced recovery time and self-confidence.

All documents cited are incorporated herein by reference; the citation of any document is not to be construed as an admission that it is prior art with respect to the present invention.

It is to be further understood that where descriptions of various embodiments use the term "comprising," and/or "including" those skilled in the art would understand that in some specific instances, an embodiment can be alternatively described using language "consisting essentially of" or "consisting of."

While particular embodiments of the present invention have been illustrated and described, it would be obvious to one skilled in the art that various other changes and modifications can be made without departing from the spirit and scope of the invention. It is therefore intended to cover in the appended claims all such changes and modifications that are within the scope of this invention.

What is claimed is:

1. A positive expiratory pressure-generating device for reducing breathlessness in a subject with one or more pulmonary disorders comprising a rigid hollow device that is configured to be held in a mouth of the subject, the rigid hollow device having at least one air chamber, at least one opening in the portion of the rigid hollow device that is configured to be held in the mouth and at least one additional airflow orifice; wherein the rigid hollow device is configured to increase expiratory resistance and further, is configured to be supported by the mouth of the subject without the need for additional support by hands or another device, additionally, wherein the rigid hollow device has a width and a height, and the width is at least twice the height of the rigid hollow device, and further, wherein the rigid hollow device is a solid molded piece with no additional parts or moving parts and wherein the at least one air chamber has a conical shape and has a volume of at least 3 cubic centimeters.

2. A system for reducing breathlessness and increasing activity in a subject with one or more pulmonary disorders comprising multiple positive expiratory pressure-generating devices according to claim 1;

wherein the at least one additional airflow orifice of the rigid hollow device for each of the multiple positive expiratory pressure-generating devices comprises a number of additional airflow orifices that is different for each of the multiple positive expiratory pressure-generating devices and the subject uses at least two of the positive expiratory pressure-generating devices to determine a preferred device for use in reducing breathlessness and increasing activity.

3. The system of claim 2 wherein the subject uses at least three of the positive expiratory pressure-generating devices to determine the preferred device for use in reducing breathlessness and increasing activity.

4. The device of claim 1 further comprising an integrated structure suitable for connecting a lanyard.

5. The device of claim 1 wherein at least 25% of the rigid hollow device is configured to be supported by lips of the subject.

6. The device of claim 1 wherein the rigid hollow device does not generate sound above an ambient sound level.

7. The device of claim 1 wherein the at least one additional airflow orifice of the rigid hollow device comprises at least two additional airflow orifices.

8. A method of reducing a subject's respiratory rate compared to the subject's normal respiratory rate comprising the subject placing a rigid hollow device in their mouth and breathing through the rigid hollow device for a period of time, the rigid hollow device having at least one air chamber, at least one opening in the portion of the rigid hollow device that is held in the mouth and at least one additional airflow orifice; wherein the rigid hollow device is configured to be supported by the mouth of the subject without the need for additional support by hands or another device, and further, wherein the subject has a breathing cycle with an exhalation phase and, when the rigid hollow device is in use, it prolongs the exhalation phase of the subject's breathing cycle, additionally, wherein the rigid hollow device has a width and a height, and the width is at least twice the height of the rigid hollow device, and further, wherein the rigid hollow device is a solid molded piece with no additional parts or moving parts and wherein the at least one air chamber has a conical shape and has a volume of at least 3 cubic centimeters.

9. The method of claim 8 wherein the subject has one or more pulmonary disorders and the method reduces breathlessness in the subject.

10. The method of claim 9 wherein said one or more pulmonary disorders are selected from disorders consisting of excessive dynamic airway collapse (EDAC), tracheobronchomalacia, bronchiectasis and chronic obstructive pulmonary disease (COPD).

11. The method of claim 8 wherein the subject has a cardiovascular disease and an elevated heart rate, blood pressure, or both; wherein the rigid hollow device, when in use, reduces the heart rate and blood pressure of the subject.

12. The method of claim 8 wherein the subject uses the rigid hollow device as part of a yoga routine, a mindful breathing exercise or both.

13. The method of claim 8 wherein the subject uses the rigid hollow device to reduce anxiety, stress or both.

14. The method of claim 8 wherein the subject uses the rigid hollow device when the subject is at rest, during exertion by the subject or during a recovery period after exertion.

15. A method of maintaining an oxygen saturation level for a subject with one or more pulmonary disorders who experiences exertional desaturation comprising the subject placing a rigid hollow device in their mouth and breathing through the rigid hollow device for a period of time, the rigid hollow device having at least one air chamber, at least one opening in the portion of the rigid hollow device that is held in the mouth and at least one additional airflow orifice; wherein the rigid hollow device is configured to be supported by the mouth of the subject without the need for additional support by hands or another device, and further, wherein, during exertion, the subject maintains an oxygen saturation level at or above 88% of a resting oxygen saturation level, additionally, wherein the rigid hollow device has a width and a height, and the width is at least twice the height of the rigid hollow device, and further, wherein the rigid hollow device is a solid molded piece with no additional parts or moving parts and wherein the at least one air chamber has a conical shape and has a volume of at least 3 cubic centimeters.

16. The method of claim 15 wherein the one or more pulmonary disorders are selected from disorders consisting of excessive dynamic airway collapse (EDAC), tracheobronchomalacia, bronchiectasis and chronic obstructive pulmonary disease (COPD).

* * * * *